US008822117B2

(12) United States Patent
Chiu et al.

(10) Patent No.: US 8,822,117 B2
(45) Date of Patent: Sep. 2, 2014

(54) CHEMICAL TONER COMPOSITION AND METHOD FOR PREPARING THE SAME

(75) Inventors: Kuei-Ying Chiu, Hsinchu (TW); Kuo-Tong Huang, Jhudong Township, Hsinchu County (TW); Ju-Feng Liao, Hsinchu (TW); I-Jein Cheng, Taichung (TW); Jui-Fa Chang, Hsinchu (TW); Chien-Sheng Huang, Hsinchu (TW); Yi-Ling Liu, Jhudong Township, Hsinchu County (TW)

(73) Assignee: Trend Tone Imaging, Inc., Hsinchu (TW)

( * ) Notice: Subject to any disclaimer, the term of this patent is extended or adjusted under 35 U.S.C. 154(b) by 1575 days.

(21) Appl. No.: 12/314,728

(22) Filed: Dec. 16, 2008

(65) Prior Publication Data

US 2010/0055591 A1 Mar. 4, 2010

(30) Foreign Application Priority Data

Aug. 29, 2008 (TW) ..... 97133048 A

(51) Int. Cl.
*G03G 9/08* (2006.01)
*G03G 9/087* (2006.01)

(52) U.S. Cl.
CPC ..... *G03G 9/0804* (2013.01); *G03G 9/08795* (2013.01); *G03G 9/08797* (2013.01); *G03G 9/08724* (2013.01); *G03G 9/08728* (2013.01); *G03G 9/08791* (2013.01)
USPC ..... 430/108.2; 430/108.1

(58) Field of Classification Search
USPC ..... 430/108.1, 108.2
See application file for complete search history.

(56) References Cited

U.S. PATENT DOCUMENTS

| | | | | |
|---|---|---|---|---|
| 5,496,676 | A * | 3/1996 | Croucher et al. | 430/137.14 |
| 2005/0048389 | A1 * | 3/2005 | Cheng et al. | 430/108.3 |
| 2006/0177756 | A1 * | 8/2006 | Sugimoto et al. | 430/109.1 |
| 2009/0155707 | A1 * | 6/2009 | Mizutani et al. | 430/109.4 |

* cited by examiner

*Primary Examiner* — Mark F Huff
*Assistant Examiner* — Rachel Zhang
(74) *Attorney, Agent, or Firm* — Bacon & Thomas, PLLC

(57) ABSTRACT

The present invention relates to a chemical toner composition and a method for preparing the same. The chemical toner composition includes: a resin emulsion; a pigment dispersion; a wax dispersion; and a dispersible polymer coagulant, wherein the dispersible polymer coagulant is a copolymer comprising unsaturated ester monomers and amino-containing monomers. Accordingly, the present invention uses a novel dispersible polymer coagulant to prepare uniform toner particles with excellent roundness and improved flowability and to reduce moisture absorption.

16 Claims, No Drawings

CHEMICAL TONER COMPOSITION AND METHOD FOR PREPARING THE SAME

BACKGROUND OF THE INVENTION

1. Field of the Invention

The present invention relates to a chemical toner composition and a method for preparing the same and, more particularly, to a chemical toner composition suitable for improving moisture resistance and controlling efficiently toner size, and a method for preparing the same.

2. Description of Related Art

Over the past years, the toner industry generally has used a pulverizing method to prepare toner, and the pulverizd toner has characteristics of larger size, wider distribution range of particle size and various shapes. In the pulverizing method, the generation of dust, small molecular compounds and noise will badly influence environment, and for industrial security, there is a danger of dust explosions. Thereby, the pulverizing method needs further improvement.

Currently, in order to obviate the aforementioned problems, the toner industry utilizes chemical synthesis methods to prepare toner. The chemical synthesis methods are performed in a liquid phase, in which toner with a lower melting point can be obtained and thus the resultant toner is suitable for low-temperature fixing to meet the requirements of energy conservation and environmental protection. In the chemical synthesis methods, the size of resultant toner can be controlled by adjusting the amount of surfactants, stirring speed, polymerization time and the concentration of solution to achieve the characteristics of uniform components, bright color and high transparency. Accordingly, the chemical toner can has perfect particle shape, smaller particle size, narrower particle size distribution and improved flowability so as to meet the requirements of the modern printing technology, such as high speed, high resolution and full colour.

In comparison to the conventional pulverizing method, the chemical synthesis methods need briefer process and can reduce cost and consumed energy. Particularly, in the chemical synthesis methods, the generation of carbon dioxide, nitrides and sulfides can be reduced by about 40% to reduce the damage to environment. In addition, the chemical synthesis methods can more precisely control the size distribution to achieve a narrower range of size distribution. For example, fine toner with an average size of 7±2 μm can be obtained by chemical synthesis methods. More importantly, when the chemical toner prepared by chemical synthesis methods is used for low-temperature imaging, the efficiency for heat fixing can be significantly enhanced, the consumed power can be reduced and printers of smaller volume can be designed.

According to the process, the chemical synthesis methods can be mainly classified into: emulsion polymerization, encapsulation, solvent-mediated grinding and suspension polymerization. Although encapsulation and suspension polymerization have the advantages of brief. process and no dust danger, several drawbacks, such as high cost, the limited shape of imaging particles to a sphere and the shape and the difficulty in controlling size of particles, exist in encapsulation and suspension polymerization. Particularly, encapsulation have another disadvantage of using organic solvents, while suspension polymerization causes environmental pollution due to the generation of a large amount of wastewater. Emulsion polymerization uses chemical coagulants to control the properties of particles, and has several advantages, such as low cost, brief process, the facility in controlling the shape of particles, solvent-free system, no dust danger and small amount of wastewater generated. Thereby, emulsion polymerization can meet the requirements of environmental protection and high equality and is the most popular method among all methods for preparing chemical toner. However, even if emulsion polymerization is predominant, there are several issues that remain unresolved, such as moisture resistance and toner adhesion.

Published U.S. Pat. No. 5,247,034 teaches that use of ammonium lauryl sarcosinate as emulsions or dispersants can improve moisture resistance and charge stability in comparison to general ionic emulsions. However, a drawback of poor toner adhesion exists in the use of ammonium lauryl sarcosinate as emulsions or dispersants.

European Patent No. 0660950B1 discloses that use of water soluble amines, including ethylene diamine, diethylene triamine, triethylene tetraamine, tetraethylene pentaamine and isophorone diamine, as coagulants can efficiently control aggregation speed. However, the excellent water solubility causes moisture absorption.

Published U.S. Pat. Nos. 6,673,500 and 6,352,810 teach that use of organic aliphatic amino esters, including diethylenetriamine, 4-aminobutyl ester, tertiary aminoester, aminosulfonate and aminosulfonite, as coagulants also causes moisture absorption due to their excellent water solubility.

Published U.S. Pat. No. 6,576,389 discloses that polyaluminum chloride (PAC) can be coated on silica to function as a coagulant. However, when polyaluminum chloride is used as a coagulant, rapid aggregation will cause the difficulty in controlling the size distribution. Although the amount of small particles can be reduced by using a large amount of polyaluminum chloride, re-aggregation will cause the formation of large particles. On the contrary, the reduction in the amount of polyaluminum chloride can efficiently control the average size in a desirable range, but the amount of small particles will increase.

SUMMARY OF THE INVENTION

The object of the present invention is to provide a chemical toner composition, in which a dispersible polymer coagulant with a lower melting point is used so as to produce uniform toner particles with excellent roundness and improved flowability and to reduce moisture absorption.

To achieve the object, the present invention provides a chemical toner composition, including: a resin emulsion; a pigment dispersion; a wax dispersion; and a dispersible polymer coagulant, wherein the dispersible polymer coagulant is a copolymer including unsaturated ester monomers and amino-containing monomers. In the chemical toner composition according to the present invention, the novel dispersible polymer coagulant can efficiently aggregate the resin emulsion, the pigment dispersion and the wax dispersion to form uniform toner particles and can significantly reduce moisture absorption. Accordingly, chemical toner with improved properties can be further provided.

In addition, the present invention further provides a method for preparing the aforementioned chemical toner composition, including: (A) providing a mixture solution including a resin emulsion, a pigment dispersion, a wax dispersion and a dispersible polymer coagulant being a copolymer comprising unsaturated ester monomers and amino-containing monomers; (B) controlling the pH value of the mixture solution in a range of 4±2; (C) performing an aggregation process at a temperature lower than the glass transition temperature of the resin emulsion; and (D) performing a fusion process at a temperature higher than the glass transition temperature of the resin emulsion. Herein, the mixture solution can be prepared by the following process: mixing a resin emulsion, a pigment dispersion and a wax dispersion and adjusting the pH value to 8±2, followed by the addition of a dispersible polymer coagulant, to form a mixture solution including the resin emulsion, the pigment dispersion, the wax dispersion and the dispersible polymer coagulant.

In the method for preparing a chemical toner composition according to the present invention, the aggregation process in step (C) is preferably performed at a temperature in a range of 30° C. to 60° C. and, more preferably, at a temperature in a range of 45° C. to 55° C.

In the method for preparing a chemical toner composition according to the present invention, the fusion process in step (D) is preferably performed at a temperature in a range of 80° C. to 100° C. and, more preferably, at a temperature in a range of 95° C. to 99° C.

Specifically, the present invention utilizes an emulsion aggregation process to prepare toner, in which a mixture solution including a resin emulsion, a pigment dispersion, a wax dispersion and a dispersible polymer coagulant is provided to perform an aggregation step and then to form micrometer-sized particles and then a fusion step is performed by heating to produce uniform toner particles with excellent roundness. Accordingly, after cooling, toner with a uniform size can be obtained by filtration, washing and drying. The resultant toner has excellent roundness and reduced moisture absorption so as to inhibit the non-uniform distribution of electric-quantity.

In the chemical toner composition and the method for preparing the same according to the present invention, the resin emulsion is used to provide fixing ability of toner. Herein, the resin emulsion can be prepared by copolymerizing carboxyl-containing monomers with acrylic monomers, styrene monomers or methyl styrene monomers. Herein, the carboxyl-containing monomers can provide good adhesion to paper, and the examples of the carboxyl-containing monomers include methacrylic acid or acrylic acid. In addition, unsaturated ester monomers, such as copolymerizable alkyl ester and phenyl ester, can provide proper molecular weight to allow the resin emulsion to have specific properties, such as aggregation/fusion property, adhesion to paper and sufficiently high glass transition temperature. For example, the monomers used for preparing the resin emulsion in the present invention can be methacrylate (such as methyl methacrylate, benzyl methacrylate, ethyl methacrylate, 2-hydroxyethyl methacrylate, hydroxylpropyl methacrylate, butyl methacrylate), or acrylate (such as methyl acrylate, benzyl acrylate, ethyl acrylate, 2-hydroxyethyl acrylate, hydroxylpropyl acrylate, butyl acrylate).

The resin emulsion used in the present invention can be prepared in an aqueous solution by copolymerization, in which the usable initiator is, for example, ammonium persulfate or potassium persulfate. In addition, in order to control the distribution of molecular weight, a chain transfer agent, such as thiol-alcohols, also can be used.

In the chemical toner composition and the method for preparing the same according to the present invention, the average polymerization degree of the resin emulsion is generally controlled in a range of about 1.2 to 4.3 and, preferably, in a range of about 1.2 to 3.8. Additionally, the glass transition temperature of the resin emulsion relates to aggregation/fusion and fixing ability of toner. In generally, the glass transition temperature of the resin emulsion is controlled in a range of 45° C. to 85° C. Preferably, it is controlled in a range of 50° C. to 65° C. More preferably, it is controlled in a range of 55° C. to 65° C.

In the chemical toner composition and the method for preparing the same according to the present invention, in order to achieve the desired fixing ability and avoid transprinting, the resin emulsion can be a mixture of a low molecular weight resin emulsion and a high molecular weight resin emulsion. Herein, the weight-average molecular weight of the low molecular weight resin emulsion is preferably in a range of about 5000 to 30000 and, more preferably in a range of about 10000 to 20000. Meanwhile, the weight-average molecular weight of the high molecular weight resin emulsion is preferably in a range of about 40000 to 70000 and, more preferably in a range of about 50000 to 60000. In addition, the ratio of the low molecular weight resin emulsion to the high molecular weight resin emulsion can be adjusted to meet various demands. For example, the weight ratio of the low molecular weight resin emulsion to the high molecular weight resin emulsion is preferably controlled in a range of 0.1 to 0.8 and, more preferably, in a range of 0.2 to 0.5.

In the chemical toner composition and the method for preparing the same according to the present invention, preferably, a pigment is first dispersed in a surfactant or a polymer dispersant to form a pigment dispersion, such that the distribution of particle size can be controlled well and the compatibility between the pigment and the resin emulsion can be improved. For example, the suitable surfactants include: anionic surfactants, such as sodium dodecylsulfate (SDS), sodium lauryl sulfate, sodium dodecylbenzene sulfonate, sodium dodecylnaphthalene sulfate, dialkyl benzenealkyl sulfates, dialkyl benzenealkyl sulfonates and abitic acid (Aldrich), NEOGEN SC-F (KAO) and Lipal 860K (Lion); cationic surfactants, such as alkylbenzyl dimethyl ammomium chloride, dialkylbenzyl dimethyl ammomium chloride, lauryl trimethyl ammonium chloride, alkylbenzyl methyl ammonium chloride, alkyl benzyl dimethyl ammonium bromide, benzalkonium chloride, cetyl pyridium bromide, $Cl_2$,$Cl_5$,$Cl_7$ trimethyl ammonium bromides, halide salts of quaternized polyoxyethylalkylamines, dodecylbenzyl triethyl ammonium chloride, SANIZOLTM (benzalkonium chloride, KAO Chemical), Levenol RC-1214 (benzalkonium chloride, KAO Chemical); and nonionic surfactants, such as polyoxyethylene cetyl ether, polyoxyethylene octylphenyl ether, polyoxyethylene octyl ether, polyoxyethylene oleyl ether, polyoxyethylene sorbitan monolaurate, polyoxyethylene stearyl ether, polyoxyethylene nonylphenyl ether, dialkylphrnoxypoly(ethyleneoxy) ethanol, IGEPAL CA-210, IGEPAL CA-520, IGEPAL CA-720, IGEPAL CO-890, IGEPAL CO-720, IGEPAL CO-290, ANTAROX 890, ANTAROX897 (Rhodia) and TERGITOL 15-S-40 (DOW Chemical). The exemplary polymer dispersants include Solsperse 27000 (Avecia). Herein, the weight ratio of the polymer dispersant to the pigment can be in a range of 1% to 100% and, preferably, in a range of 10% to 50%.

The pigment in the present invention is mainly used to provide color to toner. In the chemical toner composition, the amount of the pigment can be in a range of about 1~25% and, preferably, in a range of 3% to 15%. In general, the main pigments include black pigments, yellow pigments, magenta pigments and cyan pigments. However, in order to modify color and enhance color gamut and color chromaticity, two or more kinds of pigments can be mixed. In the chemical toner composition according to the present invention, organic pigments can be used, for example, magenta pigments, such as C. I. Pigment Red 122, C. I. Pigment Red 202, C. I. Pigment Red 206, C. I. Pigment Red 209, C. I. Pigment Red 177, C. I. Pigment Red 254, C. I. Pigment Red 269; yellow pigments, such as C. I. Pigment Yellow 13, C. I. Pigment Yellow 155, C. I. Pigment Yellow 119, C. I. Pigment Yellow 138, Pigment Yellow 139, C. I. Pigment Yellow 168; cyan pigments, such as C. I. Pigment Blue 15:3, C. I. Pigment Blue 15:4, C. I. Pigment Blue 15:6, black pigments, such as Pigment Black 7, LFF-MA7, LFF-MA100, HCF-#2650, MCF-88 (from Mitsubishi Chemical Corporation), Special 4A, FW-18 (from Degussa), S90B, Mogul L, 330R (from CABOT), RAVEN1200, RAVEN2000 (from Columbian Chemicals).

In the chemical toner composition and the method for preparing the same according to the present invention, preferably, wax is first dispersed in a surfactant, such as anionic surfactants and cationic surfactants, to form a wax dispersion. The suitable commercial products include Petrolite® 1417 (from Baker Petrolite). In addition, the wax used in the present invention can be PE wax, beeswax or carnauba wax. Preferably, the wax is beeswax or carnauba wax.

In the chemical toner composition and the method for preparing the same according to the present invention, the dispersible polymer coagulant is synthesized by copolymerizing lipophilic monomers (eg. unsaturated ester monomers, such as methacrylate and acrylate) with amino-containing monomers in an aqueous solution. Also, styrene monomers or methyl styrene monomers can be added to perform the copolymerization. For example, methacrylates include: methyl methacrylate, benzyl methacrylate, ethyl methacrylate, 2-hydroxyethyl methacrylate, hydroxylpropyl methacrylate and butyl methacrylate; and acrylates include methyl acrylate, benzyl acrylate, ethyl acrylate, 2-hydroxyethyl acrylate, hydroxylpropyl acrylate and butyl acrylate. In addition, the amino-containing monomers can be amino-containing methacrylate monomers or acrylate monomers, for example, dimethylmethylaminomethacrylate, dimethylethylamino methacrylate, and 2-(dimethylethylamino)ethylmethacrylate.

In the present invention, the form of the dispersible polymer coagulant in water can be modified by adjusting the ratio of the lipophilic monomers to the amino-containing monomers. For example, if the ratio of methacrylate (lipophilic monomers) to dimethylmethylaminomethacrylate (amino-containing monomers) is controlled in a range lower than 1/15, the dispersible polymer coagulant in water will be an aqueous solution. If the ratio of them is controlled in a range higher than 1/10, the dispersible polymer coagulant in water will be a colloidal nanoparticle dispersion. In the present invention, the size of the dispersible polymer coagulant can be in a range of about 10 nm to 1 μm.

In conclusion, the present invention uses a specific dispersible polymer coagulant to produce uniform toner particles with excellent roundness by a chemical aggregation process and to efficiently reduce moisture absorption. That is, in the present invention, a resin emulsion with nano or sub-micro size, a pigment dispersion and a wax dispersion are mixed and a specific dispersible polymer coagulant is used to perform a specific chemical aggregation process for aggregating the aforementioned particles to thereby obtain larger particles with micro size by adjusting pH value and heating, and then the micro-sized particles are fused to form uniform toner particles with excellent roughness at a temperature higher than the glass transition temperature of the resin emulsion.

Other objects, advantages, and novel features of the invention will become more apparent from the following detailed description when taken in conjunction with the accompanying drawings.

BRIEF DESCRIPTION OF THE DRAWINGS

None

DETAILED DESCRIPTION OF THE PREFERRED EMBODIMENT

Preparation Example 1-1

Preparation of Low Molecular Weight Resin Emulsion (Surfactant Type)

First, deionized water (586.77 g) and sodium lauryl sulfate (2.02 g, from SHOWA Co.) are first added into a reaction bottle (2000 mL) and nitrogen gas is inputted therein. Additionally, in a plastic beaker (1000 mL), sodium lauryl sulfate (1.435 g), deionized water (399.23 g), styrene (441.21 g, from ECHO Co.), butyl acrylate (121.04 g, from ACROS), methacrylic acid (13.89 g, from SHOWA) and dodecyl mercaptan (15.30 g, from ACROS) are admixed to form a monomers-containing solution, and then to be adequately stirred for 10 minutes by a high-speed mixer. Subsequently, the monomers-containing solution is taken as 99.21 g and added into the aforementioned reaction bottle, followed by the rise in temperature from room temperature to 70° C., and then an initiator (ammonium sulfate of 8.05 g, from SHOWA Co.) predissolved in deionized water (40 g) is added therein. Meanwhile, the addition of the remaining monomers-containing solution is accomplished at 80° C. after 2 hours, and then the reaction is continuously performed for additional 4 hours. After the reaction is accomplished, the reaction solution is cooled to room temperature. Finally, the obtained particles are measured to get the following data: 84 nm of size, 14010 g of Mw (molecular weight), 1987 g of Mn (number-average molecular weight), 36.96% of solid content, and 55.8° C. of Tg (glass transition temperature).

Preparation Example 1-2

Preparation of High Molecular Weight Resin Emulsion (Surfactant Type)

The process for preparing a high molecular weight resin emulsion (surfactant type) is the same as that described in Preparation Example 1-1, except that in the preparation example dodecyl mercaptan (1.5 g, from ACROS) and ammonium persulfate (1.0 g, from SHOWA Co.) are used as a chain transfer agent and an initiator, respectively. After the reaction is accomplished, the obtained particles are measured to get the following data: 94 nm of size, 53649 g of Mw (molecular weight), 14132 g of Mn (number-average molecular weight), 38.96% of solid content, and 57.8° C. of Tg (glass transition temperature).

Preparation Example 1-3

Preparation of Low Molecular Weight Resin Emulsion (Non-Surfactant Type)

Styrene (55.4 g, from Acros Co.), butylacrylate (14.2 g, from Acros Co.), 1-dodecanethiol (1.2 g, from Aldrich) and a resin aqueous solution (10%, 160 g, form Eastman Chemical AQ 55S) are added into a beaker (500 mL) to form a solution, and then to be adequately stirred for 10 minutes by a high-speed mixer. Additionally, deionized water (141.8 g) and the aforementioned solution (taken as 23 g) are added into a four-necked bottle (500 mL) equipped with a refluxing condenser under nitrogen and heated up to 70° C. Subsequently, an aqueous solution of ammonium persulfate (1.23 g) dissolved in deionized water (40 g) is added therein to perform reaction for 30 minutes. Subsequently, the temperature is raised to 80° C., and the addition of the remaining aforementioned solution is performed at 80° C. by a dosing bump and accomplished after 2 hours, followed by the continuous performance of the reaction for additional 4 hours at 80° C. After the reaction is accomplished, the reaction solution is cooled. Finally, the obtained particles are measured to get the following data: 98 nm of size, 20% of solid content, 19000 g of Mn (number-average molecular weight) and 58° C. of Tg (glass transition temperature).

Preparation Example 1-4

Preparation of High Molecular Weight Resin Emulsion (Non-Surfactant Type)

The process for preparing a high molecular weight resin emulsion (non-surfactant type) is the same as that described in Preparation Example 1-3, except that in the preparation example 1-dodecyl mercaptan (0.12 g) and ammonium persulfate (0.15 g.) are used as a chain transfer agent and an initiator, respectively. After the reaction is accomplished, the obtained particles are measured to get the following data: 110 nm of size, 19.8% of solid content, 55752 g of Mw (molecular weight), 15112 g of Mn (number-average molecular weight) and 57.8° C. of Tg (glass transition temperature).

Preparation Example 2-1

Preparation of a Pigment Dispersion (Surfactant Type)

A PE milling jar (250 mL) is provided and zirconium particles of 1 mm diameter is added therein by an amount equivalent to a half volume of the PE milling jar, followed by the addition of a pigment (5 g), deionized water (100 g), an assistant (DEUCHEN® DP-16, 0.5 g) and a surfactant (SANIZOL B50, 1 g, from Kao Co.), as shown in Table 1. Subsequently, a red devil mixer is used for performing dispersion for 4 hours. Mill pearls are filtrated out to collect dispersion, and then the obtained particles are measured by a particle size analyzer (ELS-800, from OTSUKA). The results are given in Table 1.

TABLE 1

Data of surfactant-typed pigment dispersion

| No. | pigment | particle size (nm) |
|---|---|---|
| SBk-1 | Carbon Black (Cabot ® MOGUL L) | 103.8 |
| SC-1 | Pigment blue 15:3 (Clariant) | 105.5 |
| SM-1 | Pigment Red 122 (Clariant) | 98.8 |
| SY-1 | Pigment Yellow 155 (Clariant) | 115.7 |

Preparation Example 2-2

Preparation of a Pigment Dispersion (Non-Surfactant Type)

A PE milling jar (250 mL) is provided and zirconium particles of 1 mm diameter is added therein by an amount equivalent to a half volume of the PE milling jar, followed by the addition of a pigment (5 g), deionized water (100 g), an assistant (DEUCHEN® DP-16, 0.5 g) and a resin (Eastman Chemical AQ 55S, 1.5 g), as shown in Table 2. Subsequently, a red devil mixer is used for performing dispersion for 4 hours. Mill pearls are filtrated out to collect dispersion, and then the obtained particles are measured by a particle size analyzer (ELS-800, from OTSUKA). The results are given in Table 2.

TABLE 2

Data of non surfactant-typed pigment dispersion

| No. | pigment | particle size (nm) |
|---|---|---|
| SFBk-1 | Carbon Black (Cabot ® MOGUL L) | 105.9 |
| SFC-1 | Pigment blue 15:3 (Clariant) | 108.7 |
| SFM-1 | Pigment Red 122 (Clariant) | 110.5 |
| SFY-1 | Pigment Yellow 155 (Clariant) | 121.3 |

Preparation Example 3-1

Preparation of Dissoluble Coagulant

Deionized water (170.5 g) and ammonium persulfate (0.83 g) are added into a four-necked bottle (500 mL) equipped with a refluxing condenser under nitrogen and stirred for 1 minute. Subsequently, 2-(dimethylethylamino)ethylmethacrylate monomers (15.9 g, from Acros Co.) and nitric acid (6.25 g) are added into the four-necked bottle and stirred for 3 minutes, followed by the addition of 1-dodecyl mercaptan (1.0 g, form Aldrich). The temperature is raised to 90° C. and then maintained to perform the reaction for 4 hours at stirring speed of 300 rpm. The resultant solid content is 11.7% and the yield is 95.1%.

Preparation Example 3-2

Preparation of Dispersible Coagulant

Deionized water (170.5 g) and ammonium persulfate (0.83 g) are added into a four-necked bottle (500 mL) equipped with a refluxing condenser under nitrogen and stirred for 1 minute. Subsequently, 2-(dimethylethylamino)ethylmethacrylate monomers (15.9 g, from Acros Co.) and nitric acid (6.25 g) are added into the four-necked bottle and stirred for 3 minutes, followed by the addition of 1-dodecyl mercaptan (1.0 g, form Aldrich). The temperature is raised to 90° C. and then maintained to perform the reaction for 1 hour at stirring speed of 300 rpm, followed by the addition of methyl methacrylate (40 g, from Aldrich) to perform the reaction for 4 hours. The resultant solid content is 24.7% and the yield is 91.5%.

Example 1

The low molecular weight resin emulsion obtained from Preparation Example 1-3 and the high molecular weight resin emulsion obtained from Preparation Example 1-4 are mixed in a weight ratio of 4/1, and the pH value is adjusted to 8. The mixed resin emulsion is taken as 26 g and added into a beaker (250 mL), followed by the addition of deionized water (50 g) and then stirring at 800 rpm for 5 minutes at room temperature. Subsequently, a wax dispersion (Baker Petrolite® 1417, 4.5 g) is added therein and stirred for 5 minutes at room temperature, followed by the addition of a black pigment dispersion (SFBk-1, 22 g) and stirring for 10 minutes at room temperature. Next, nitric acid (10%, 2.8 g) and a dispersible coagulant (3 g) are added therein in sequence, and then stirred for 5 minutes. The temperature is raised to a range of 92° C.

to 95° C. to perform the reaction for 5 hours. Black toner is obtained by filtration and drying. The results are given in Table 3.

Example 2

The process in the present example is the same as that described in Example 1, except that a blue pigment dispersion (SFC-1) is used in place of the black pigment dispersion (SFBk-1, 22 g). The results are given in Table 3.

Example 3

The process in the present example is the same as that described in Example 1, except that a red pigment dispersion (SFM-1) is used in place of the black pigment dispersion (SFBk-1, 22 g). The results are given in Table 3.

Example 4

The process in the present example is the same as that described in Example 1, except that a yellow pigment dispersion (SFY-1), the low molecular weight resin emulsion obtained from Preparation Example 1-1 and the high molecular weight resin emulsion obtained from Preparation Example 1-2 are used in place of the black pigment dispersion (SFBk-1, 22 g), the low molecular weight resin emulsion obtained from Preparation Example 1-3 and the high molecular weight resin emulsion obtained from Preparation Example 1-4, respectively.

Comparison Example 1

The low molecular weight resin emulsion obtained from Preparation Example 1-3 and the high molecular weight resin emulsion obtained from Preparation Example 1-4 are mixed in a weight ratio of 4/1, and the pH value is adjusted to 8. The mixed resin emulsion is taken as 26 g and added into a beaker (250 mL), followed by the addition of deionized water (50 g) and then stirring at 800 rpm for 5 minutes at room temperature. Subsequently, a wax dispersion (Baker Petrolite® 1417, 4.5 g) is added therein and stirred for 5 minutes at room temperature, followed by the addition of a black pigment dispersion (SFBk-1, 22 g) and stirring for 10 minutes at room temperature. Next, nitric acid (10%, 2.8 g) and a dissoluble coagulant (3 g) are added therein in sequence, and then stirred for 5 minutes. The temperature is raised to a range of 92° C. to 95° C. to perform the reaction for 5 hours. Black toner is obtained by filtration and drying. The results are given in Table 3.

Comparison Example 2

The process in the present example is the same as that described in Comparison Example 1, except that a blue pigment dispersion (SFC-1) is used in place of the black pigment dispersion (SFBk-1, 22 g). The results are given in Table 3.

Comparison Example 3

The low molecular weight resin emulsion obtained from Preparation Example 1-1 and the high molecular weight resin emulsion obtained from Preparation Example 1-2 are mixed in a weight ratio of 4/1, and the pH value is adjusted to 8. The mixed resin emulsion is taken as 26 g and added into a beaker (250 mL), followed by the addition of deionized water (50 g) and then stirring at 800 rpm for 5 minutes at room temperature. Subsequently, a wax dispersion (Baker Petrolite® 1417, 4.5 g) is added therein and stirred for 5 minutes at room temperature, followed by the addition of a black pigment dispersion (SBk-1, 22 g) and stirring for 10 minutes at room temperature. Next, nitric acid (10%, 2.8 g) and polyaluminum chloride aqueous solution (10%, 15 g) are added therein in sequence, and then stirred for 5 minutes. The temperature is raised to a range of 92° C. to 95° C. to perform the reaction for 5 hours. Black toner is obtained by filtration and drying. The results are given in Table 3.

Comparison Example 4

The process in the present example is the same as that described in Comparison Example 3, except that a blue pigment dispersion (SC-1) is used in place of the black pigment dispersion (SFBk-1, 22 g). The results are given in Table 3.

TABLE 3

| | Pigment dispersion | Coagulant | D50 | Roughness |
|---|---|---|---|---|
| Example 1 | SFBk-1 | dispersible coagulant | 8.9 μm | 0.97 |
| Example 2 | SFC-1 | dispersible coagulant | 6.0 μm | 0.96 |
| Example 3 | SFM-1 | dispersible coagulant | 8.5 μm | 0.98 |
| Example 4 | SFY-1 | dispersible coagulant | 7.8 μm | 0.97 |
| Comparison Example 1 | SFBk-1 | dissoluble coagulant | >1 mm | Non-uniform |
| Comparison Example 2 | SFC-1 | dissoluble coagulant | >1 mm | Non-uniform |
| Comparison Example 3 | SBC-1 | polyaluminum chloride | 7.08 μm | 0.86 |
| Comparison Example 4 | SC-1 | polyaluminum chloride | 8.13 μm | 0.90 |

From the above results, it can be found that the dispersible polymer coagulant can effectively control the size of toner particles to obtain toner particles with improved roughness.

Although the present invention has been explained in relation to its preferred embodiment, it is to be understood that many other possible modifications and variations can be made without departing from the scope of the invention as hereinafter claimed.

What is claimed is:

1. A chemical toner composition, comprising:

a resin;

a pigment;

a wax; and a dispersible polymer coagulant, wherein the dispersible polymer coagulant is a copolymer including unsaturated ester monomers and amino-containing monomers.

2. The chemical toner composition as claimed in claim 1, wherein the glass transition temperature of the resin ranges from 50° C. to 65° C.

3. The chemical toner composition as claimed in claim 1, wherein the glass transition temperature of the resin ranges from 55° C. to 65° C.

4. The chemical toner composition as claimed in claim 1, wherein the average polymerization degree of the resin ranges from 1.2 to 4.3.

5. The chemical toner composition as claimed in claim 1, wherein the average polymerization degree of the resin ranges from 1.2 to 3.8.

6. The chemical toner composition as claimed in claim 1, wherein the resin is a mixture of a low molecular weight resin with a weight-average molecular weight in a range of 5000 to 30000 and a high molecular weight resin with a weight-average molecular weight in a range of 40000 to 70000.

7. The chemical toner composition as claimed in claim 6, wherein the weight-average molecular weight of the low molecular weight resin ranges from 10000 to 20000 and the weight-average molecular weight of the high molecular weight resin ranges from 50000 to 60000.

8. The chemical toner composition as claimed in claim 6, wherein the weight ratio of the low molecular weight resin to the high molecular weight resin is in a range of 0.1 to 0.8.

9. The chemical toner composition as claimed in claim 6, wherein the weight ratio of the low molecular weight resin to the high molecular weight resin is in a range of 0.2 to 0.5.

10. The chemical toner composition as claimed in claim 1, wherein the pigment is composed of a pigment and a surfactant or a polymer dispersant in which the pigment is dispersed.

11. The chemical toner composition as claimed in claim 1, wherein wax is composed of wax and a surfactant or a polymer dispersant in which the wax is dispersed.

12. The chemical toner composition as claimed in claim 1, wherein the unsaturated ester monomers are acrylate monomers or methacrylate monomers.

13. The chemical toner composition as claimed in claim 1, wherein the amino-containing monomers are amino-containing acrylate monomers or amino-containing methacrylate monomers.

14. The chemical toner composition as claimed in claim 1, wherein the weight ratio of the unsaturated ester monomers to the amino-containing monomers is in a range of 1/15 to 1/2.

15. The chemical toner composition as claimed in claim 1, wherein the weight ratio of the unsaturated ester monomers to the amino-containing monomers is in a range of 1/10 to 1/2.

16. The chemical toner composition as claimed in claim 1, wherein the size of the dispersible polymer coagulant ranges from 10 nm to 1 μm.

* * * * *